United States Patent [19]

Radvan et al.

[11] 3,937,273

[45] Feb. 10, 1976

[54] FORMING NON-WOVEN FIBROUS MATERIAL

[75] Inventors: Bronislaw Radvan, Flackwell Heath; Kieron Philip Green, Thame, both of England

[73] Assignee: Wiggins Teape Limited, London, England

[22] Filed: Nov. 18, 1974

[21] Appl. No.: 524,814

[30] Foreign Application Priority Data

Nov. 26, 1973 United Kingdom ..... 54694/73

[52] U.S. Cl. ..... 162/212; 162/216; 162/322; 162/344

[51] Int. Cl.[2] ..... D21F 1/02

[58] Field of Search ..... 162/322, 324, 213, 215, 162/212, 214, 216, 317, 344, 345

[56] References Cited

UNITED STATES PATENTS

| | | | |
|---|---|---|---|
| 1,519,698 | 12/1924 | Nishina | 162/213 X |
| 3,321,360 | 5/1967 | Holt | 162/214 |
| 3,846,230 | 11/1974 | Wahren et al. | 162/216 |

*Primary Examiner*—Arthur D. Kellogg
*Attorney, Agent, or Firm*—Burns, Doane, Swecker & Mathis

[57] ABSTRACT

In a method of making non-woven fibrous material such as paper, the papermaking stock as it is being delivered to the foraminous support of a papermaking machine has air under pressure introduced into it to produce foaming of the stock and the stock is subjected to turbulence. This is effected by providing the head-box of the papermaking machine with a slice the body of which includes a slot through which the stock flows to the foraminous support and which is shaped to impart turbulence to the stock. The body also includes an air supply passage which communicates with the slot to introduce the pressurised air into the stock.

17 Claims, 3 Drawing Figures

FORMING NON-WOVEN FIBROUS MATERIAL

BACKGROUND OF THE INVENTION

1. Field of the Invention

This invention relates to a method and apparatus for use in the manufacture of non-woven fibrous material such as paper.

2. Description of the Prior Art

Paper and other non-woven fibrous materials are conventionally made by depositing a suspension of fibres in a liquid medium, usually water, onto a foraminous support, for example the wire of a Fourdrinier-type paper making machine, which allows the liquid medium to drain through while retaining most of the fibres on the wire in the form of a web.

A problem encountered with such methods is that the fibres in the suspension have an inherent tendency to form flocs, or clumps, which are difficult to disperse, and may remain in the formed web, imparting to it an uneven appearance and adversely affecting its useful properties. This problem is particularly serious when dealing with suspensions of relatively long fibres, or of synthetic fibres, or when using relatively high concentrations of fibre in the suspension, as may be the case if a heavy web is to be produced, or if the web is of inherently slow draining fibres, or if the speed of the paper making machine is high, or if it is important to reduce the costs of purifying the drained liquid medium.

The problem of flocculation of fibres can be mitigated by using very low concentrations of fibres in water, i.e. concentrations of the order of 10 mg/l to 100 mg/l instead of the more usual 1 g/l to 10 g/l, but this involves the handling of very large quantities of water, which in general is not commercially practicable.

It has also been proposed to overcome the problem of flocculation by producing even dispersions of fibres in high viscosity solutions of polymeric materials, but the use of such fibre suspensions on a paper making machine severely limits productivity, because of the inherent slow rate of drainage of such viscous suspending liquid media.

It has also been proposed to overcome the problem of flocculation by producing uniform dispersions of fibres in foams made from air dispersed in water in the presence of a foaming agent (see for example British Patent Specification No. 1,209,409). Such foams drain relatively easily, and do not restrict unduly the productivity of a paper making machine. It is thought that the advantageous rheology of such foams results from the presence of closely packed rigid bubbles which behave like a pseudo-plastic body, which restricts the movement of fibres, and so prevents their flocculation, but yields under the stresses involved in fibre dispersion and drainage. Relatively high concentrations of foaming agents in the suspension have so far been found necessary to impart sufficient stability to the foam to enable it to carry the dispersed fibres from the dispersing apparatus to the foraminous support. Such foaming agents are thought to interfere with the forces which bond conventional paper making fibres, and therefore their presence tends to reduce the density and strength of the paper product obtained. This problem can be overcome at least to some extent by using a greater degree of beating of the fibres, or by the addition of strengthening agents, but it would be advantageous if the amount of surfactant used could be reduced.

Another method of overcoming the problem of flocculation has been proposed which uses a paper making machine headbox slice in which is a very shallow (e.g. 0.5 to 3.0 mm) passage having a series of sharp bends therein. When a fibre dispersion is passed through the passage, the bends set up high intensity, small-scale turbulence in the dispersion which tends to break up any fibre flocs in the dispersion. The dispersion is then passed through a second very shallow passage and delivered directly on to a foraminous support, such as the wire of a paper making machine. The turbulence of the flow of the dispersion is said to decay in the second passage and the resistance to shear of the well dispersed mass of fibres at the high concentration of the dispersion tends to prevent flocculation, or re-flocculation, occuring. Dispersions having fibre concentrations of 30 to 40 g/l are said to be usable with the slice just described. However, such a slice has the disadvantage that it is only really suitable for making papers of a high substance, because the concentrated dispersion delivers excessive amounts of fibre to the wire even when the second passage is as shallow as 2–3 mm. Moreover, we have found that the turbulence set up is not completely effective in dispersing clumps of fibres, which may clog the shallow passage. Adventitious matter may also do this. A further problem is that there are serious engineering problems in making a slice having such shallow passages therein.

SUMMARY

We have now found that improved results can be obtained by foaming and creating turbulence in a foamed dispersion of fibres while the dispersion is in the headbox slice.

Accordingly, therefore, the present invention provides in a first aspect a method of papermaking in which gas is introduced into papermaking stock during passage of the stock through a slot in a headbox slice, thereby to foam the stock, and in which turbulence is imparted to the stock by virtue of the shape of the slot.

In a second aspect, the present invention provides a slice for the headbox of a papermaking machine, comprising a body in which is a slot for flow of stock from a headbox chamber to a papermaking wire, and a gas supply passage which communicates with the slot for foaming stock therein, the slot being shaped such that in use turbulence is imparted to stock flowing therethrough.

The gas, which is normally air, may be introduced between two zones of turbulence imparted to the stock, or before turbulence is imparted. Two zones of turbulence may be provided by two oppositely-directed substantially right angled portions being present in the slot. Alternatively, a single zone of turbulence may be provided at the outlet end of a portion of the slot of enlarged cross-section beyond the inlet of the slot, gas preferably being introduced at the inlet end of the slot. Advantageously, such a portion has a concave surface opposite the stock inlet and a convex surface opposite the gas inlet. In an alternative embodiment of slice in which the gas is introduced before turbulence is imparted, at least one porous plate is advantageously provided which defines a stock flow passage within the slot, and the gas supply passage communicates with said stock flow passage through said porous plate(s).

The depth of the slot may with advantage increase in depth towards its outlet, so as to allow for the increase of stock volume on foaming.

In order to accommodate the foam produced, the slot in the slice is of larger dimensions, e.g. several millimeters, than the very shallow passages referred to earlier in connection with a previously proposed headbox. Consequently, the engineering problems involved in producing such a slice are not so serious, and being deeper, the slot in the present apparatus is less prone to clogging.

Advantageously, a member, e.g. a flap, is mounted at the outlet end of the slice for overlying the wire of the papermaking machine. Preferably, the member is pivotally mounted on the slice, and means are provided for adjusting the position of the member whereby in use the spacing between the member and the wire can be varied. Such a member presses the stock through the wire, instead of relying solely on gravity for drainage, and promotes controlled discharge of stock.

Conveniently, the slot is of substantially rectangular cross-section and has a width which is substantially the same as that of the wire with which the slice is going to be used. It is thought that the turbulence imparted to the stock has the effect of dispersing any fibre flocs, and of dispersing the gas bubbles in the foam. The gas bubbles are thought to prevent or at least hinder re-flocculation of the dispersed fibres. Provided the air content of the foam is suitably chosen, e.g. 50 to 70 percent, the turbulence causes dispersion of the gas into numerous small bubbles which behave like a packed mass of apparently rigid spheres and which are able to resist the shearing forces of turbulence. Because re-flocculation is avoided, the present method and apparatus may be used for making light weight papers and non-woven materials, as well as strong and dense papers.

It will be appreciated that since the stock is foamed only shortly before it reaches the wire, it is unnecessary for the foam to be very stable. We have found that it is possible to dispense with the need for foam stabilisers to be present in the stock, or at least with the need for foam stabilisers to be present in the relatively large concentrations required when stock is foamed before reaching the headbox. This eliminates or reduces the aforementioned problem of strength loss resulting from the use of foam stabilisers, and also makes effluent control easier. Alternatively, the foam may be stabilised by materials such as starch or carboxymethylcellulose which do not have the disadvantages of conventional foam stabilisers.

Two further advantages accruing from the absence or near absence of foam stabilisers is that retention of loadings and pigments is improved, and that handling of liquid which has drained through the wire is easier. Loadings and pigments tend to be dispersed by foam stabilisers, i.e. agglomerates are broken up, and in finely dispersed form they are more likely to pass through the web. When liquid which has drained through the wire is pumped or allowed to flow away, the resulting agitation may tend to lead to foam formation. If foam stabiliser is absent any foam produced soon collapses, whereas it tends to remain and cause problems if foam stabiliser is present.

DESCRIPTION OF THE PREFERRED EMBODIMENTS

Figure 1:
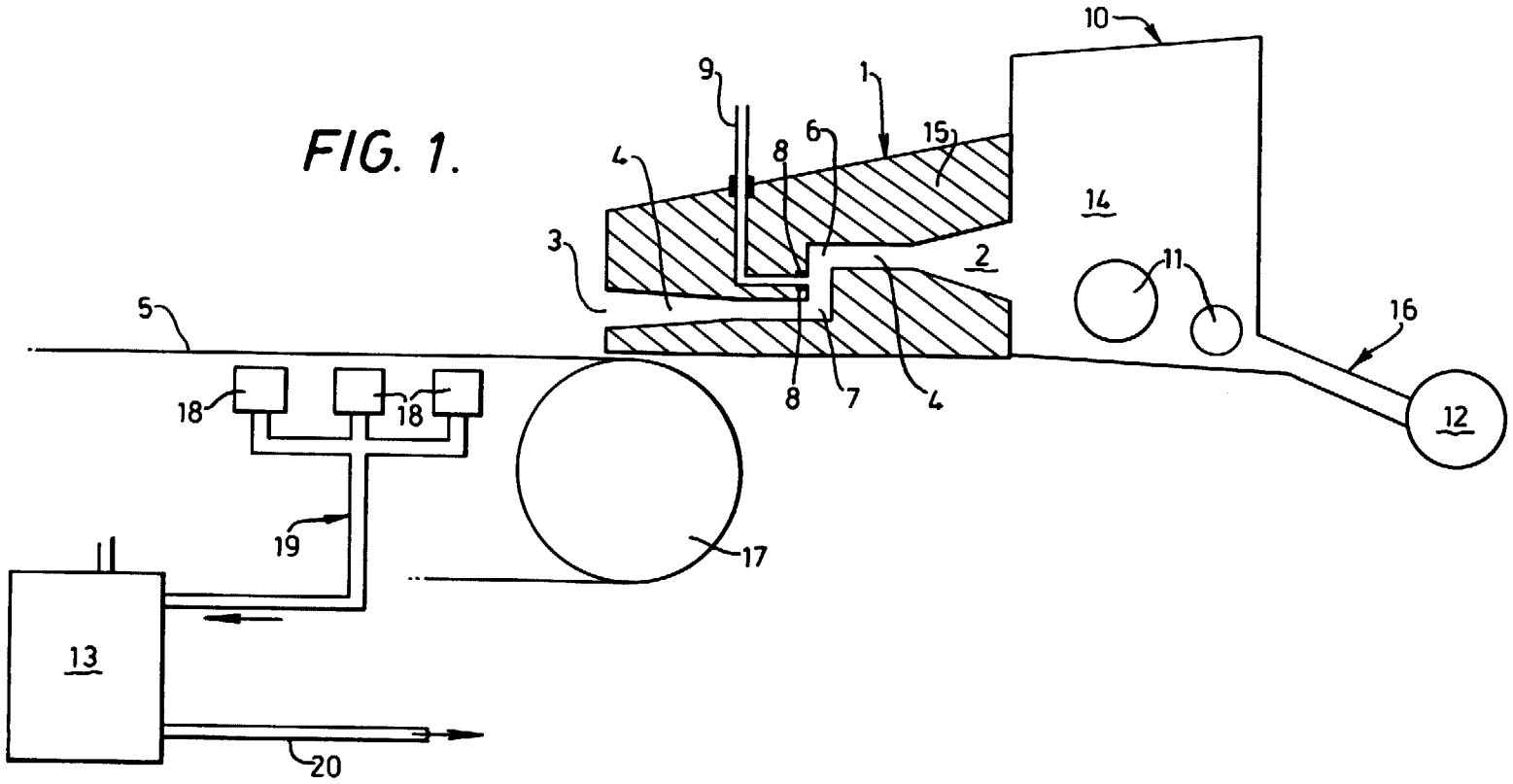
FIG. 1 diagrammatically illustrates, in vertical section, a headbox of a papermaking machine having fitted thereto a slice according to the invention, FIG. 2 diagrammatically illustrates an alternative embodiment of the slice, and FIG. 3 diagrammatically illustrates a further alternative embodiment of the slice.

Referring first to FIG. 1, a headbox generally designated 10 comprises a stock-containing chamber 14 and a slice 1. The slice 1 comprises a body 15 which defines a slot for confining and directing the flow of stock from the chest 14 to a papermaking machine wire 5. The slot comprises an inlet 2 and an outlet 3, connected by a central portion 4. Both the inlet and the outlet taper towards the portion 4, which is rectangular in transverse cross-section, i.e. at right angles to the direction of stock flow. The portion 4 includes two oppositely directed right-angled portions 6 and 7. A pipe 9 extends through the body 15 and communicates with the central portion 4 of the passage between the angled portions 6 and 7. The pipe 9 has an injection nozzle 8 where it communicates with the portion 4.

The stock-containing chest contains holey rolls 11 for evening stock flow, and is connected by piping 16 to a flow distributor 12.

The outlet 3 of the slice 1 is disposed above the breast roll 17 of the papermaking machine. Suction boxes 18 are disposed beneath the wire 5 and are connected by piping 19 to an air separator 13, from which piping 20, only a part of which is shown, leads back to the headbox 10. The flow direction in the piping 19 and 20 is denoted by arrows.

In use of the apparatus, a dispersed fibre stock is pumped from the flow distributor 12 to the chamber 14 of the headbox, the holey rolls serving to even the flow. From the chamber the stock passes through the inlet 2 into the passage 4 and through the angled portion 6. The taper of the inlet 2 and the changes of direction in the angled portions 6 and 7 impart high-intensity small-scale turbulence to the flow. A gas, normally air, is passed through the pipe 9 and is discharged into the stock through the nozzle 8, causing further turbulence and causing the stock to foam. The foamed stock then passes through the angled portion 7, which induces further turbulence, and out through the outlet 3 onto the wire 5. The taper of the outlet allows for the increase in stock volume on foaming and also modifies the flow rate of the stock onto the wire. The liquid in the foam drains through the wire, with the aid of the suction boxes 18, leaving a wet paper web on the wire. Air entrained with the liquid from the foam is removed at the separator 13. The turbulence imparted to the stock at the portion 6 serves to break up and disperse any fibre flocs which may be present, and the turbulence imparted at the portion 7 serves to disperse the air in the stock as very small bubbles.

The amount of air added may be controlled by means of the nozzle 8, and this control, the choice of consistency of the stock, and its flow rate through the passage 4 enable the properties of the foam obtained to be controlled.

Figure 2:
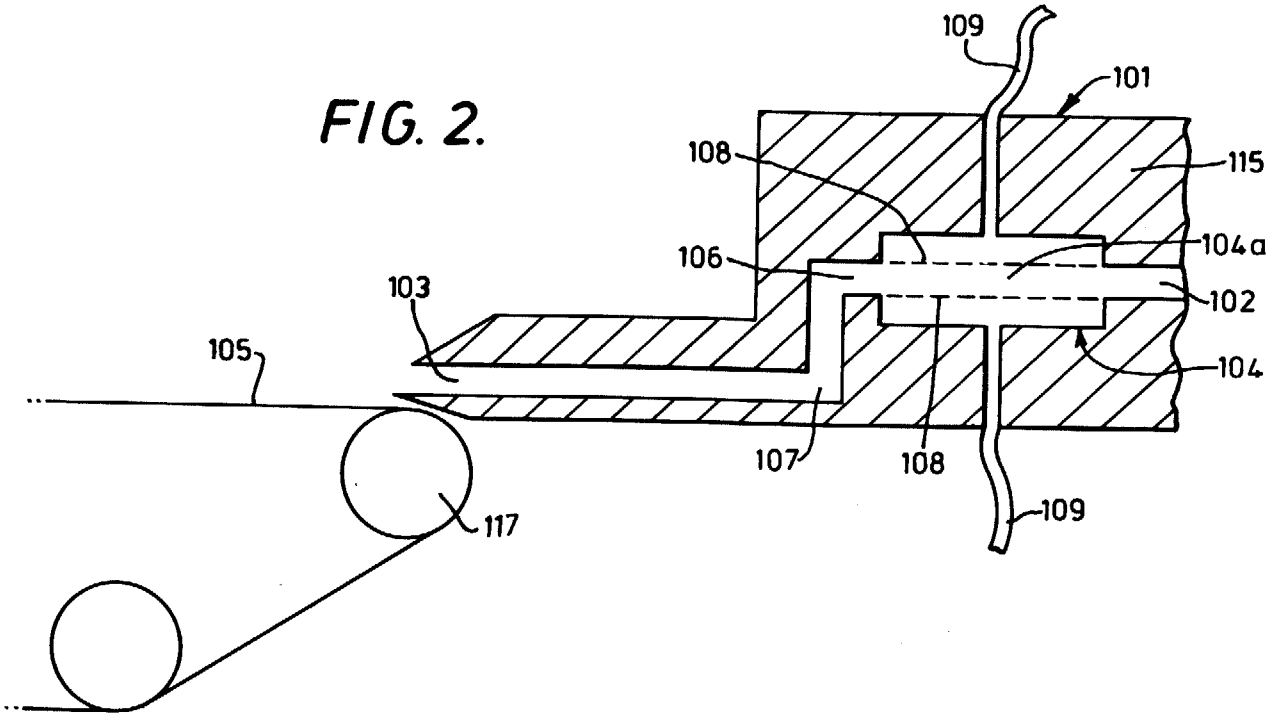

Referring now to FIG. 2, there is shown a slice generally designated 101 positioned above and to the right of a breast roll 117 of a papermaking machine having a wire 105. The remainder of the headbox and the parts beneath the wire have been omitted for the sake of simplicity. They may be substantially the same as shown in FIG. 1.

The slice 101 comprises a body 115 which defines a slot for flow of stock from the stock chest to the wire 105. The slot, which is substantially of the same width as the wire 105, comprises an inlet 102, an outlet 103, a pair of right-angled portions 106 and 107 the function of which is as described with reference to the angled portions 6 and 7 shown in FIG. 1, and a central portion or chamber 104 between the angled portion 106 and the inlet 102. The chamber 104 is rectangular in transverse cross-section and is of greater depth than the remainder of the slot. A pair of porous metal or ceramic plates 108, e.g. sintered metal or ceramic plates, are disposed in the chamber 104 and are spaced apart to define a stock flow passage 104*a* which extends along a predetermined length of the flow of stock. A pair of pipes 109 extend through the body 115 and communicate with the chamber 104. The depth of the slot is chosen in accordance with the desired quantity and dilution of stock to be used.

In use of the apparatus, stock flows through the inlet 102 into the passage 104*a*, and air (or other gas) is pumped through the pipes 109 into the chamber 104, from whence it passes through and is dispersed by the porous plates 108 and foams the stock. The foamed stock then passes through the turbulence-inducing angled portions 106 and 107 to the outlet 103, and thence onto the wire.

Figure 3:
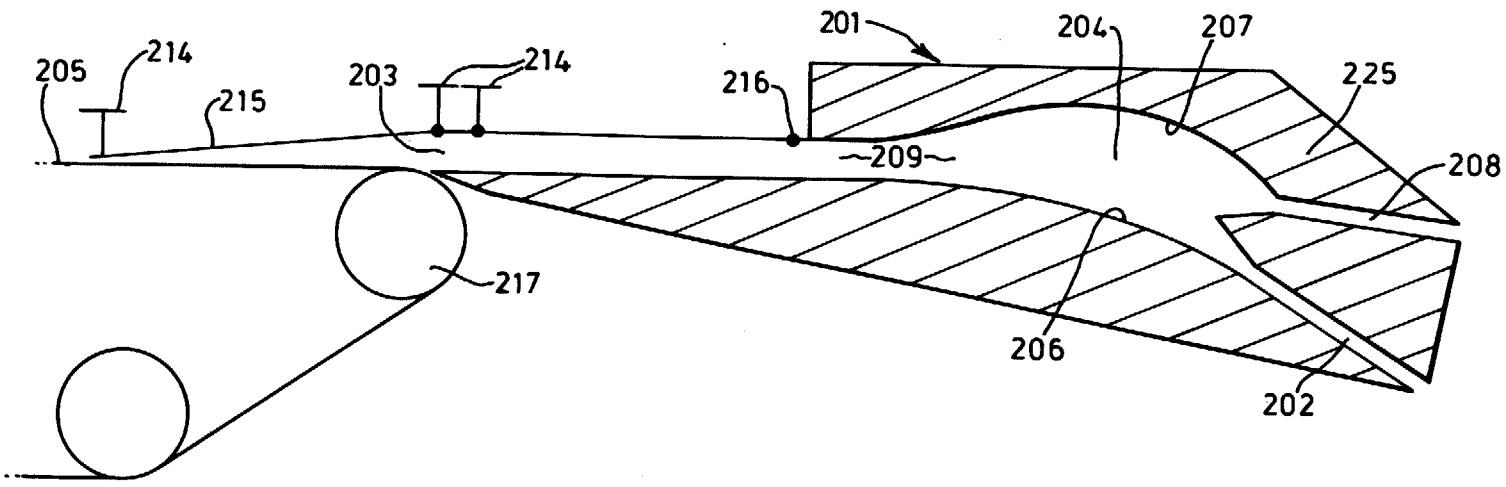

Referring now to FIG. 3, there is shown a slice generally designated 201 positioned above and to the right of a breast roll 217 of a papermaking machine having a wire 205. As with FIG. 2, the remainder of the headbox and the parts beneath the wire have been omitted for the sake of simplicity. They may be substantially as shown in FIG. 1.

The slice 201 comprises a body 225 which defines a slot for flow of stock from the stock chest to the wire 105. The slot, which is substantially of the same width as the wire 105, comprises a stock inlet 202, an outlet 203 and a central portion 204 having a concave upper surface 207 and a convex lower surface 206. The portion 204 is of greater depth than the remainder of the slot. An air inlet 208 communicates with the portion 204. The outlet 203 has a flap member 215, which overlies part of the wire 205. The flap member is pivotally mounted on the body at 216. The dimensions of the outlet can be varied by adjusting the position of the flap member 215 by means of jacks 214.

In use of the apparatus, stock passes through the inlet 202 into the slot portion 204, and air (or other gas) passes through the inlet 208 to foam the stock. The dimensions and shape of the portion 204 are such that high-intensity small-scale turbulence is set up at the end 209 thereof, with the results described previously with regard to FIG. 1. The foamed stock then passes through the outlet 203 and onto the wire.

The use of an adjustable flap member 215 to extend the slice over a portion of the wire may also be employed with advantage in the embodiment shown in FIG. 2.

The invention will now be further illustrated by reference to the following Examples, which relate to an experimental paper machine:

EXAMPLE 1

In this Example, a slice as described with reference to FIG. 2 was used, except that the slice was extended by a flap member 215 to overlie the wire, as described with reference to FIG. 3. The slice had a slot width of 78 mm, and a depth of 5 mm from the inlet 102 up to and including the right-angled portions 106 and 107. Thereafter, the depth increased gradually to 10 mm at the outlet 103. The height of the end of the flap member 215 above the wire was 4 mm.

Free-beaten softwood sulphate stock at a consistency of 12 g/l was delivered through the headbox at a rate of flow of 50 l/min on to the wire 5 which was running at a speed of 136 m/min. Air under pressure was supplied through the porous plates 8 at a volumetric rate of flow of 52 l/min at Standard Temperature and Pressure. The stock was drained on the wire by conventional suction boxes, and the web of paper formed on the wire was removed, and pressed and dried on a separate apparatus. When dried, the web had a basis weight (after shrinkage)) of 64 g/m$^2$.

EXAMPLE 2

The same apparatus was used as in Example 1, except that the depth of the slot increased gradually from 5 mm at the angled portion 107 to 8 mm at the outlet 3.

A mixture of 90 percent by weight of free-beaten sulphate pulp, and 10 percent very heavily beaten sulphate pulp at a total consistency of 15 g/l, was delivered through the apparatus at a rate of 92 l/min. The stock contained 200 parts per million by weight of a mixture of equal weight proportions of (1) a soluble papermakers size sold under the trade name "Pexol" (2) soluble gelatin (3) lactic casein, and (4) carboxymethyl cellulose. Air under pressure was admitted through the porous plates 8 at a volumetric rate of flow of 92 l/min at Standard Temperature and Pressure.

With the wire running at a speed of 256 m/min, a web of paper was taken off, and dried to a basis weight (after shrinkage) of 77 g/m$^2$.

EXAMPLE 3

In this Example, a slice as described in with reference to FIG. 3 was used. The slot width was 100 mm and the slot depth was 10 mm between the zone 209 and the outlet 203, and the flap member 215 was lowered so that the distance of its end from the wire 205 was 2 mm.

The same stock as was used in Example 1 but at a consistency of 8.3 g/l and was delivered at a volumetric rate of flow of 92 l/min. Air under pressure was admitted through the air inlet 208 at a volumetric rate of flow of 184 l/min at Standard Temperature and Pressure. With the wire 205 running at a speed of 117 m/min, a web of paper was taken off, and pressed and dried on a separate apparatus. Its basis weight (after shrinkage) was 64 g/m$^2$.

We claim:

1. A method of making non-woven fibrous material such as paper comprising the steps of:

confining and directing a flow of stock through a slot toward a foraminous support;

breaking up and dispersing fibre flocs by imparting turbulence to the confined flow in the slot;

effecting foaming of the confined stock by introducing gas under pressure into the confined flow of stock in the slot;

dispersing gas contained in the foamed stock as very small bubbles by imparting turbulence to the confined flow of foamed stock at a slot location downstream from the introduction of the gas;

delivering the confined foamed stock having the broken up and dispersed fibre flocs and the dispersed very small bubbles from the slot onto the foraminous support; and draining the stock on the foraminous support.

2. The method according to claim 1, wherein the gas is introduced into the flow of stock between a first zone of turbulence imparted to the confined flow of stock to break up and disperse the fibre floc and a second zone of turbulence imparted to disperse the gas in the foamed stock.

3. The method according to claim 1, wherein the gas is introduced into the confined flow before substantial turbulence is imparted to the confined flow of stock to break up and disperse the fibre flocs.

4. The method according to claim 3, wherein the gas introduced into the confined flow of stock is dispersed along a predetermined length of the flow of stock.

5. The method according to claim 1, wherein the gas is introduced into one end of an enlarged flow confining region and turbulence is imparted to the stock at the downflow end of said region and remote from the position of gas introduction to break up and disperse the fibre floc and to disperse the gas in the foamed stock.

6. A slice for the headbox of a papermaking machine, comprising:

a body including a slot to confine and direct a flow of stock from a headbox chamber toward the papermaking wire of the machine;

said slot being shaped to impart sufficient turbulence to the confined flow therein as to break up and disperse fibre flocs;

a gas supply passage communicating with said slot and operable to introduce gas under pressure into the confined flow of stock in the slot so as to effect foaming of the confined stock;

said slot being shaped, at a slot location downstream from the slot location communicating with said gas supply passage, to impart sufficient turbulence to the confined flow of foamed stock to disperse gas contained therein as very small bubbles.

7. A slice according to claim 6, wherein the slot includes a pair of oppositely-directed substantially right-angled portions effective to impart turbulence to stock flowing through the slot.

8. A slice according to claim 6, wherein the slot includes a portion of enlarged cross-section between its inlet and outlet ends, said portion being effective to impart turbulence to stock flowing through the slot at the end of said portion remote from the inlet end of the slot.

9. A slice according to claim 7, wherein the gas supply passage communicates with the slot between said right-angled portions.

10. A slice according to claim 7, wherein the gas supply passage communicates with the slot between said right-angled portions and the inlet end of the slot.

11. A slice according to claim 9, wherein at least one porous plate defines a stock flow passage within the slot and the gas supply passage communicates with the stock flow passage through the porous plate(s).

12. A slice according to claim 8, wherein the gas supply passage communicates with the slot at said portion of enlarged cross-section and at the end of said portion remote from the outlet end of the slot.

13. A slice according to claim 9, wherein the slot includes a portion of enlarged cross-section between its inlet and outlet ends, said portion being effective to impart turbulence to stock flowing through the slot at the end of said portion remote from the inlet end of the slot.

14. A slice according to claim 8, wherein said portion of enlarged cross-section has a concave surface opposite the stock inlet thereto and a convex surface opposite the gas inlet thereto.

15. A slice according to claim 6, wherein the slot increases in depth towards the outlet end of the slot.

16. A slice according to claim 6, wherein a flap member extends from the outlet end of the slice and is arranged to overlie the papermaking wire of the machine.

17. A slice according to claim 16, wherein the flap member is pivotally mounted on the slice, and wherein means are provided for adjusting the position of the flap member whereby in use the spacing between the flap member and the papermaking wire can be varied.

* * * * *